US007065967B2

(12) United States Patent
Kalina

(10) Patent No.: US 7,065,967 B2
(45) Date of Patent: Jun. 27, 2006

(54) PROCESS AND APPARATUS FOR BOILING AND VAPORIZING MULTI-COMPONENT FLUIDS

(75) Inventor: Alexander I. Kalina, Hillsborough, CA (US)

(73) Assignee: Kalex LLC, Belmont, CA (US)

( * ) Notice: Subject to any disclaimer, the term of this patent is extended or adjusted under 35 U.S.C. 154(b) by 250 days.

(21) Appl. No.: 10/674,073

(22) Filed: Sep. 29, 2003

(65) Prior Publication Data

US 2005/0066661 A1 Mar. 31, 2005

(51) Int. Cl.
*F01K 25/06* (2006.01)

(52) U.S. Cl. ..... 60/649; 60/651; 60/671

(58) Field of Classification Search ..... 60/649, 60/651, 671

See application file for complete search history.

(56) References Cited

U.S. PATENT DOCUMENTS

| | | | | | |
|---|---|---|---|---|---|
| 3,712,073 | A | * | 1/1973 | Arenson | 62/50.2 |
| 4,346,561 | A | | 8/1982 | Kalina | 60/641.6 |
| 4,442,679 | A | * | 4/1984 | Stafford et al. | 62/123 |
| 4,489,563 | A | | 12/1984 | Kalina | 60/673 |
| 4,548,043 | A | | 10/1985 | Kalina | 60/649 |
| 4,586,340 | A | | 5/1986 | Kalina | 60/649 |
| 4,604,867 | A | | 8/1986 | Kalina | 60/653 |
| 4,674,285 | A | | 6/1987 | Durrant et al. | 10/646 |
| 4,704,877 | A | * | 11/1987 | Selcukoglu | 62/532 |
| 4,732,005 | A | | 3/1988 | Kalina | 60/649 |
| 4,753,758 | A | * | 6/1988 | Miller | 261/139 |
| 4,763,480 | A | | 8/1988 | Kalina | 60/678 |
| 4,899,545 | A | | 2/1990 | Kalina | 60/673 |
| 4,982,568 | A | | 1/1991 | Kalina | 60/649 |
| 5,029,444 | A | | 7/1991 | Kalina | 60/673 |
| 5,095,708 | A | | 3/1992 | Kalina | 60/673 |
| 5,440,882 | A | | 8/1995 | Kalina | 60/641.2 |
| 5,450,821 | A | | 9/1995 | Kalina | 122/1 R |
| 5,572,871 | A | | 11/1996 | Kalina | 60/649 |
| 5,588,298 | A | | 12/1996 | Kalina et al. | 60/676 |
| 5,603,218 | A | | 2/1997 | Hooper | 60/655 |
| 5,649,426 | A | | 7/1997 | Kalina et al. | 60/649 |
| 5,754,613 | A | | 5/1998 | Hashiguchi et al. | 376/378 |
| 5,822,990 | A | | 10/1998 | Kalina et al. | 60/649 |
| 5,893,410 | A | * | 4/1999 | Halbrook | 165/118 |
| 5,950,433 | A | | 9/1999 | Kalina | 60/649 |
| 5,953,918 | A | | 9/1999 | Kalina et al. | 60/653 |
| 6,347,520 | B1 | | 2/2002 | Ranasinghe et al. | 60/649 |

* cited by examiner

*Primary Examiner*—Hoang Nguyen
(74) *Attorney, Agent, or Firm*—Robert W Strozier

(57) ABSTRACT

A new boiler or heat transfer apparatus is disclosed for use with multi-component working fluids which includes a vapor removal apparatus designed to maintain a substantial compositional identity between the boiling liquid and its vapor along a length of the apparatus resulting in the maintenance of substantially nucleate boiling along the entire length of the apparatus. Systems incorporating the apparatus and methods for making and using the apparatus are also disclosed.

10 Claims, 4 Drawing Sheets

PROCESS AND APPARATUS FOR BOILING AND VAPORIZING MULTI-COMPONENT FLUIDS

BACKGROUND OF THE INVENTION

1. Field of the Invention

The present invention relates to an improved boiler apparatus, systems incorporating the boiler apparatus and to methods for making and using the boiler apparatus and systems incorporating the boiler apparatus.

More particularly, the present invention relates to an improved boiler apparatus, systems incorporating the boiler apparatus and to methods for making and using the boiler apparatus and systems incorporating the boiler apparatus, where the boiler apparatus includes a vapor removal unit that remove vapor as it boils so that the boiling throughout boiler's length remains substantially nucleate boiling.

2. Description of the Related Art

In several processes and especially in power systems using multi-component working fluids, it is necessary to completely vaporize such multi-component fluids. However, it is, in practice difficult to completely vaporize such multi-component fluid.

When a working fluid in the form of a saturated liquid is sent into a boiler, and the quantity of vapor in the stream of working fluid is relatively small, the boiling process is characterized as nucleate boiling. Nucleate boiling has a very high film heat transfer coefficient, but as vapor accumulates, a so-called crisis of boiling occurs. This crisis of boiling results in a drastic fall or reduction in the film heat transfer coefficient.

On the other hand, when a single-component fluid is vaporized, the liquid can be recycled within the heat exchanger and nucleate boiling can be sustained throughout the entire process. But, such an approach cannot be used with multi-component fluids, because the vapor produced will have a different composition (enriched by the low boiling component) than the remaining liquid resulting in a continuous composition profile across the heat exchanger with the concurrent crises of boiling.

Thus, if a multi-component fluid needs to be vaporized fully, the in a significant proportion of this vaporization process, i.e., inside the heat exchanger or boiler, nucleate boiling cannot be maintained. Thus, the film heat transfer coefficient in such a process is very low. This results in a very large increase in the required surface of the heat exchanger or boiler.

If complete vaporization of a multi-component working fluid has to be performed at high temperature, e.g., in a furnace of a power plant, then the inability of the process to maintain nucleate boiling inside heat transfer tubes of the furnace makes such a process technically very difficult.

When nucleate boiling is maintained, due to a high film heat transfer coefficient, the temperature of the metal of the heat transfer tubes is maintained close to the temperature of the boiling fluid, and as a result the tubes are protected from burn out. However, because in the process of direct vaporization of multi-component working fluids where nucleate boiling cannot be maintained, the heat transfer tubes can achieve unacceptably high temperatures resulting in tube damage or destruction.

Thus, there is a need in the art for process and apparatus for boiling and vaporization of multi-component fluids designed to achieve the production of vapor of the same composition as the composition of the initial multi-component liquid, and at the same time, to maintain a process of nucleate boiling in the heat transfer apparatus.

SUMMARY OF THE INVENTION

The present invention provides an improved boiler apparatus including a heat transfer unit and a vapor removal/equilibration apparatus, where the heat transfer unit and the vapor removal/equilibration unit are configured in such as way as to support substantially nucleate boiling throughout the heat transfer unit and to ensure that the vapor produced is in substantial equilibrium with the whether the boiling apparatus is used to substantially fully or completely vaporize or to partially vaporize a multi-component working fluid, where the multi-component working fluid comprises at least one lower boiling component and at least one higher boiling component.

The present invention also provides an improved vaporization apparatus for multi-component working fluids including a plurality of heat transfer apparatuses, each apparatus including a heat exchange unit and a vapor removal or collector unit, where the vapor collector units are adapted to maintain substantially nucleate boiling throughout each heat exchange unit and where the vaporization apparatus converts a portion of a liquid multi-component fluid feed stream having a given composition into a vapor stream having substantially the same composition.

The present invention provides a system for extracting heat from a heat source and converting a portion of the heat into a useable form of energy including a heat source stream, a multi-component working fluid, a vaporization apparatus of this invention, and a heat extraction system.

The present invention provides a method for vaporizing a liquid multi-component working fluid having a given composition into a vapor multi-component working fluid having substantially the same compositions, where the method includes the step of feeding a liquid stream of the multi-component working fluid into an improved multi-component working fluid vaporization apparatus of this invention, where the stream can be from a energy production facility. The stream is heated by a heat source stream from a heat source, which leaves the apparatus as a spent heat source stream and sending a vapor multi-component working fluid stream back to the energy production facility, where the liquid multi-component working fluid and the vapor multi-component working fluid have substantially the same composition and the vaporization apparatus maintains substantially nucleate boiling throughout all heat exchange units.

The present invention provides a methods for vaporizing a multi-component working fluid having a given composition including the steps feeding an input stream comprising a multi-component working fluid having a given composition into one or a plurality of heat transfer apparatuses, each heat transfer apparatus including a heat exchange unit and a vapor equilibration unit and transferring heat from a heat source to a liquid portion of the input stream in such a way as to produce a vapor stream and optionally a remaining liquid stream, where the vapor stream and the remaining liquid stream have substantially the same compositions as the input stream. The vapor removal units associated with each heat transfer apparatus ensure that substantially nucleate boiling occurs throughout each heat exchange unit and ensure that the liquid and vapor are substantially equilibrated.

DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1:
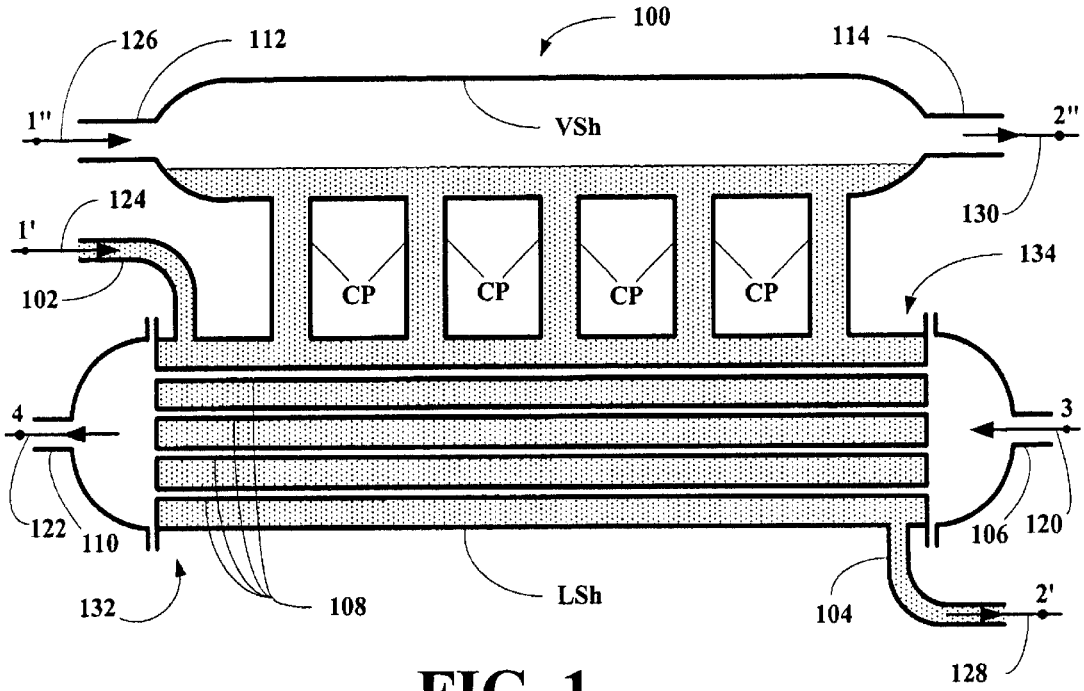
FIG. 1 depicts a diagram of a preferred embodiment of a heat transfer apparatus of this invention having a vapor removal apparatus.

The inventors have found that a heat transfer apparatus can be constructed for substantially, fully vaporizing a working fluid comprising at least two components one component having a boiling point less than the other component or at least one lower boiling component and at least one higher boiling component, which includes a vapor removal system adapted to maintain substantially nucleate boiling in a boiling/vaporization zone of the apparatus.

The present invention broadly relates to an improved boiling apparatus for substantially completely vaporizing a multi-component fluid to obtain a desired vapor stream having a desired temperature and composition, where the boiling apparatus includes at least one heat transfer apparatus, where each heat transfer apparatus comprises a heat exchanger, heat transfer loop or mixture thereof and a vapor removal apparatus. The removal of vapor at each heat transfer stage maintains nucleate boiling in each of the heat transfer apparatuses. The heat transfer unit includes a liquid shell, a vapor shell and a plurality of connecting pipes which allow vapor and liquid to exchange between the liquid shell and the vapor shell. The plurality of connecting pipes is at least 2, the basic start for a plurality, preferably between about 2 and about 20, preferably, between about 4 and about 20 and particularly between about 5 and about 20. Moreover, the present invention can include an elongated slot with perforations for better exchange of vapor and liquid between the liquid shell and the vapor shell.

The present invention also broadly relates to a method for substantially maintaining nucleate boiling through each stage of a boiling apparatus including the steps of feeding a multi-component stream into at least one heat transfer apparatus, each heat transfer apparatus includes a vapor collectors or separator apparatus, where the apparatus allows substantially complete vaporization of the multi-component fluid while maintaining nucleate boiling throughout each heat transfer apparatus.

The working fluids to be vaporized in the inventions of this application are multi-component fluids that comprises a lower boiling point component fluid—the low-boiling component—and a higher boiling point component—the high-boiling component. Preferred working fluids include, without limitation, an ammonia-water mixture, a mixture of two or more hydrocarbons, a mixture of two or more freon, a mixture of hydrocarbons and freon, or the like. In general, the fluid can comprise mixtures of any number of compounds with favorable thermodynamic characteristics and solubility. In a particularly preferred embodiment, the fluid comprises a mixture of water and ammonia.

It should be recognized by an ordinary artisan that at those point in the systems of this invention where a stream is split into two or more sub-streams, the valves that effect such stream splitting are well known in the art and can be manually adjustable or are dynamically adjustable so that the splitting achieves the desired improvement in efficiency. It should also be recognized that stream mixing is affected by an mixer valve also well known in the art.

Suitable heat exchange units include, without limitation, heat exchangers, heat transfer loops, or any other unit that can transfer heat from a heat source to a working fluid stream. Suitable vapor removal units include, without limitation, vapor/liquid separators such as drums or separation tanks, vapor collector or any other unit that can remove a vapor from a mixed vapor-liquid stream.

The term substantially when used with a composition means that the composition to two streams differs by no more than 5% in each component, preferably, no more than 2% in each component, particularly, no more than 1% in each component and especially, no more than 0.5% in each component, with zero (identical streams) being the ultimate goal. The term substantially when used in conjunction with nucleate boiling means that no more than 10% of the boiling that occurs in the heat exchange units is non-nucleate boiling, preferably, no more than 5% of the boiling that occurs in the heat exchange units is non-nucleate boiling, particularly, no more than 2.5% of the boiling that occurs in the heat exchange units is non-nucleate boiling, especially, no more than 1% of the boiling that occurs in the heat exchange units is non-nucleate boiling, with the ultimate goal being 0% of the boiling that occurs in the heat exchange units is non-nucleate boiling.

In several processes and especially in power systems using multi-component working fluids, it is necessary to completely vaporize such multi-component fluids. However it is, in practice, difficult to obtain complete vaporization directly for the following reasons.

When a working fluid in the form of saturated liquid is sent into a boiler, and the quantity of vapor in the stream of working fluid is relatively small, the boiling process is characterized as a nucleate boiling. Such a boiling process has a very high film heat transfer coefficient, but as vapor accumulates, a so-called crisis of boiling occurs, and the heat transfer coefficient drastically falls. Therefore, when single-component fluids are vaporized, the liquid is recycled within the heat exchanger and nucleate boiling can be sustained throughout the entire process. But, such an approach cannot be used directly when it is necessary to vaporize a multi-component fluid, because the vapor produces will have a different composition (enriched by the low boiling component). Thus, if a multi-component fluid needs to be vaporized fully, in a significant proportion of the vaporization process, nucleate boiling cannot be maintained, and thus the heat transfer coefficient in such a process is very low. This results in a very large increase in the required surface area of the heat exchanger.

If complete vaporization of a multi-component working fluid has to be performed at high temperature, e.g., in a furnace of a power plant, then the inability of the process to maintain nucleate boiling inside heat transfer tubes makes such a process technically very difficult. When nucleate boiling is maintained, due to a high film heat transfer coefficient, the temperature of the metal of the heat transfer tubes is maintained close to the temperature of the boiling fluid, and as a result the tubes are protected from burn out. However, because in the process of direct vaporization of multi-component working fluid, nucleate boiling cannot be maintained the heat transfer tubes will attain an unacceptably high temperature and will be destroyed.

The apparatus of this invention for boiling and vaporization of multi-component fluids is designed to achieve the production of vapor of the same composition as the composition of the initial multi-component liquid, (in case of complete vaporization) or vapor which is in equilibrium with liquid exiting the apparatus (in case of partial vaporization) and at the same time, to maintain a process of nucleate boiling in the heat transfer apparatus(es).

Unlike the systems disclosed in co-pending U.S. application Ser. No. 10/617,367 filed 10 Jul. 2003 and incorporated herein by reference, the systems of this invention are designed to operate effectively without a scrubber. The removal of the scrubber greatly simplifies the boiling equipment construction, system design, system cost and system simplicity.

Referring now to FIG. 1, a flow diagram of a preferred embodiment of a boiling apparatus of this invention generally 100, is shown to include a liquid shell LSh, which is in essence a standard horizontally disposed shell-and-tube heat exchanger, a vapor shell VSh, which comprises a horizontal drum or hollow vessel installed above the liquid shell LSh, and a plurality of vertically disposed, connecting pipes CPs, which interconnect the liquid shell LSh and the vapor shell Vsh. The liquid shell LSh also includes a liquid stream inlet 102 and a liquid stream outlet 104. The liquid shell LSh further includes a heat source stream input 106, a plurality of heat transfer tubes 108 and a heat source stream output 110. The vapor shell VSH includes a vapor stream input 112 and a vapor stream output 114.

The apparatus 100 is designed to operate with an entire volume of the liquid shell LSh, an entire volume of the connecting tubes CPs and a lower portion of the vapor shell VSh being filled with liquid as shown by the dotted areas of the LSh and VSh. This configuration ensures that vaporization occurs in the liquid shell LSh in a substainally nucleate boiling process and that the produced vapor is sufficiently mixed with the liquid so that the liquid and vapor exiting the apparatus 100 are in equilibrium or are in substantial equilibrium.

The apparatus 100 of this invention operates by feeding a heat source stream 120, a hot liquid stream such as a geothermal brine stream, having initial parameters as at a point 3 into the liquid shell LSh via the heat source stream input 106. The heat source stream 120 passes through the heat transfer tubes 108 where it is cooled and leaves the liquid shell LSh as a spent heat source stream 122 having parameters as at a point 4 via the heat source stream output 110.

The apparatus 100 of FIG. 1 is designed to operate on a partially vaporize or mixed input stream (not shown) which is to be subjected to boiling and vaporization and further but not completely vaporized within the apparatus 100. In other words, the described process of FIG. 1 is a process of intermediate vaporization, as distinct from initial or final vaporization. The mixed stream enters the apparatus 100 as a liquid input stream 124 having parameters as at a point 1' via the liquid input 102 of the liquid shell LSh, while a vapor input stream 126 having parameters as at a point 1" via the vapor input 112 of the vapor shell VSh. The liquid input stream 124 passes through the liquid shell LSh where it is heated by the heat source stream and partially boils exiting the liquid shell LSh as a non-boiled liquid stream 128 having parameters as at a point 2' via the liquid output 104 of the liquid shell LSh. The vapor input stream 126 passes through the vapor shell VSh where it is fully mixed with the boiling liquid from the input liquid stream 124 rising up through the connecting tube CPs to form an output vapor stream 130 having parameters as at a point 2" via the vapor output 114 of the vapor shell VSh.

The stream to be further vaporized, which is comprised from a stream of vapor and a stream of liquid, enters into the apparatus as the liquid stream 124 and the vapor stream 126. The vapor stream 126 having the parameters as at the point 1" enters into the vapor shell VSh via the input 112 and the liquid stream 124 having the parameters as at the point 1' enters into the liquid shell Lsh via the input 102. As a result of heating, the liquid of the stream 124 which fills the liquid shell LSh, the connecting pipes CPs and the lower portion of the vapor shell VSh, varies its temperature and composition along a length of the apparatus 100; the stream 124 is cool and rich in light-component composition at a cold end 132 of the apparatus 100, and the stream 124 is hot and lean in light-component composition at a hot end 134 of the apparatus 100. As the liquid boils throughout the apparatus 100, bubbles of vapor move up and through the connecting pipes Cps and into the vapor shell VSh, carrying with them liquid (i.e., creating a thermo-syphoning effect). As a result of this thermo-syphoning, a significant quantity of liquid is delivered to the vapor shell VSh where it is thoroughly mixed with vapor in the vapor stream 126, bringing the vapor in the stream 126 into equilibrium with the liquid in the stream 124. It is self-evident that each connecting pipe CP delivers liquid having a different temperature and composition into the vapor shell VSh. With each addition of boiling liquid into the vapor in the vapor shell VSh, the vapor is the vapor shell VSh is brought step-wise into equilibrium with the liquid in the liquid shell LSh. Of course, as boiling liquid in the liquid shell LSh is moving up through the connecting pipes CPs and into the vapor shell VSh, liquid in the VSh is continually flowing down int the liquid shell LSh, an integral part of the mixing and equilibration process. As a result, the heat from the heat source fluid is transferred to the boiling liquid in a process of nucleate boiling, and then transferred to the vapor by way of mixing (i.e., direct contact heat and mass transfer).

Again, vapor produced in the apparatus 100 is then removed from the vapor shell VSh as the output vapor stream 130 having the parameters as at the point 2", while the remaining, non-vaporized liquid stream 128 is removed from the liquid shell LSh having the parameters as at the point 2'. Due to the intensive mixing of liquid and vapor achieved in the vapor shell VSh via the connecting pipes CPs, vapor and liquid of the stream 130 and 128 having the parameters as at the points 2" and 2', respectively, are in equilibrium or very close to equilibrium, which is the purpose of the apparatus 100.

Figure 2:
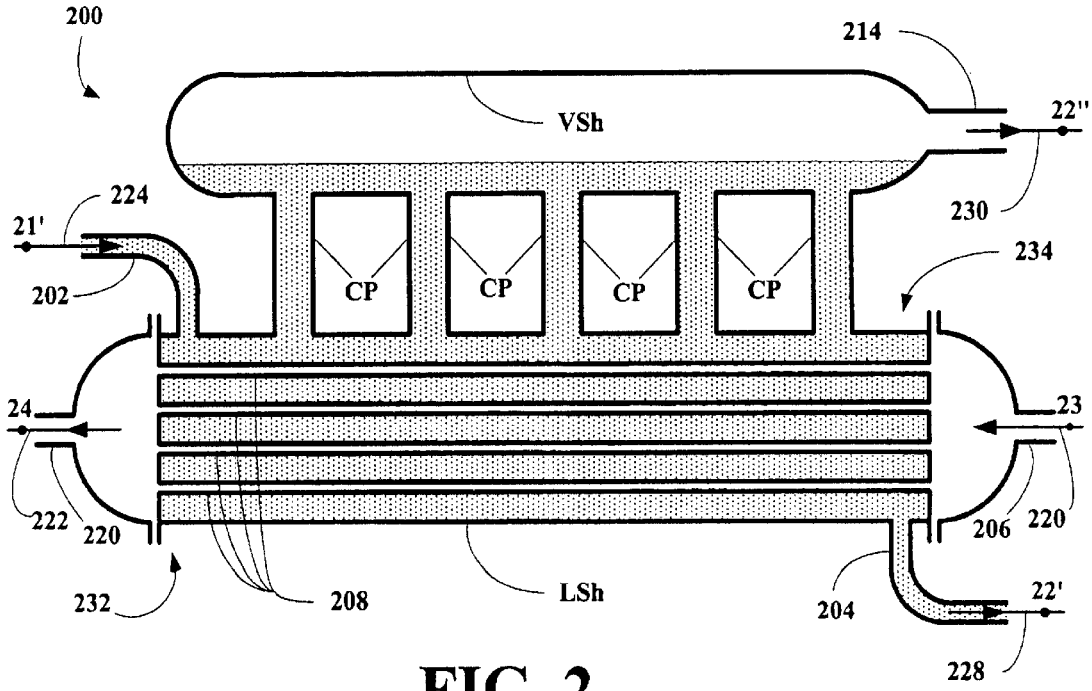
FIG. 2 depicts a diagram of another preferred embodiment of a heat transfer apparatus of this invention having a vapor removal apparatus.

Referring now to FIG. 2, a flow diagram of a preferred embodiment of an initial boiling apparatus of this invention generally 200, is shown to include a liquid shell LSh, which is in essence a standard horizontally disposed shell-and-tube heat exchanger, a vapor shell VSh, which comprises a horizontal drum or hollow vessel installed above the liquid shell LSh, and a plurality of vertically disposed, connecting pipes CPs, which interconnect the liquid shell LSh and the vapor shell Vsh. The liquid shell LSh also includes a liquid stream inlet 202 and a liquid stream outlet 204. The liquid shell LSh further includes a heat source stream input 206, a plurality of heat transfer tubes 208 and a heat source stream output 210. In this embodiment, the vapor shell VSH include only a vapor stream output 214. In a case, the apparatus of this invention functions as an initial vaporization unit, i.e., the stream to be vaporized is comprised only of saturated liquid, then vapor is not introduced into the vapor shell VSh.

Like the apparatus 100 of FIG. 1, the apparatus 200 is designed to operate with an entire volume of the liquid shell LSh, an entire volume of the connecting tubes CPs and a lower portion of the vapor shell VSh being filled with liquid as shown by the dotted areas of the LSh, CPs and VSh. This configuration ensures that vaporization occurs in the liquid shell LSh in a substainally nucleate boiling process and that the produced vapor is sufficiently mixed with the liquid so that the liquid and vapor exiting the apparatus 200 are in equilibrium or are in substantial equilibrium.

The apparatus 200 of this invention operates by feeding a heat source stream 220, a hot liquid stream such as a geothermal brine stream, having initial parameters as at a point 23 into the liquid shell LSh via the heat source stream input 206. The heat source stream 220 passes through the heat transfer tubes 208 where it is cooled and leaves the liquid shell LSh as a spent heat source stream 222 having parameters as at a point 24 via the heat source stream output 210.

The apparatus 200 of FIG. 2 is designed to operate on a saturated liquid which is to be subjected to boiling and vaporization, but not complete vaporization. In other words, the described process of FIG. 2 is a process of initial partial vaporization, as distinct from intermediate or final vaporization. The liquid enters the apparatus 200 as a saturated liquid input stream 224 having parameters as at a point 21' via the liquid input 202 of the liquid shell LSh The liquid input stream 224 passes through the liquid shell LSh where it is heated by the heat source stream 220 and partially boils exiting the liquid shell LSh as a non-boiled liquid stream 228 having parameters as at a point 22' via the liquid output 204 of the liquid shell LSh. As liquid of input stream 224 boils in the liquid shell LSh, the boiling liquid from the input liquid stream 224 rises up through the connecting tube CPs and into the vapor shell VSh where the produced vapor is fully mixed with the liquid to form an output vapor stream 230 having parameters as at a point 22" via the vapor output 214 of the vapor shell VSh. As a result of heating, the liquid of the stream 224 which fills the liquid shell LSh, the connecting pipes CPs and the lower portion of the vapor shell VSh, varies in temperature and composition along a length of the apparatus 200; the stream 224 is cool and rich in light-component composition at a cold end 232 of the apparatus 200, and the stream 224 is hot and lean in light-component composition at a hot end 234 of the apparatus 200. As the liquid boils throughout the apparatus 200, bubbles of vapor move up and through the connecting pipes Cps and into the vapor shell VSh, carrying with them liquid (i.e., creating a thermo-syphoning effect). As a result of this thermo-syphoning, a significant quantity of liquid is delivered into the vapor shell VSh where it is thoroughly mixed with the vapor in the vapor shell VSh, bringing the vapor into equilibrium with the liquid in the stream 124. It is self-evident that each connecting pipe CP delivers liquid having a different temperature and composition into the vapor shell VSh. With each addition of boiling liquid into the vapor shell VSh, the vapor in the vapor shell VSh is brought step-wise, step-by-step, into equilibrium with the liquid in the liquid shell LSh. Of course, as boiling liquid in the liquid shell LSh moves up through the connecting pipes CPs and into the vapor shell VSh, liquid in the VSh is continually flowing down into the liquid shell LSh, an integral part of the mixing and equilibration process. As a result, the heat from the heat source fluid is transferred to the boiling liquid in a process of nucleate boiling, and then transferred to the vapor by way of mixing (i.e., direct contact heat and mass transfer).

Again, vapor produced in the apparatus 200 is then removed from the vapor shell VSh as the output vapor stream 230 having the parameters as at the point 22", while the remaining, non-vaporized liquid stream 228 is removed from the liquid shell LSh having the parameters as at the point 22'. Due to the intensive mixing of liquid and vapor achieved in the vapor shell Vsh via the connecting pipes CPs, vapor and liquid of the stream 230 and 228 having the parameters as at the points 22" and 22', respectively, are in equilibrium or very close to equilibrium, which is the purpose of the apparatus 200.

Figure 3:
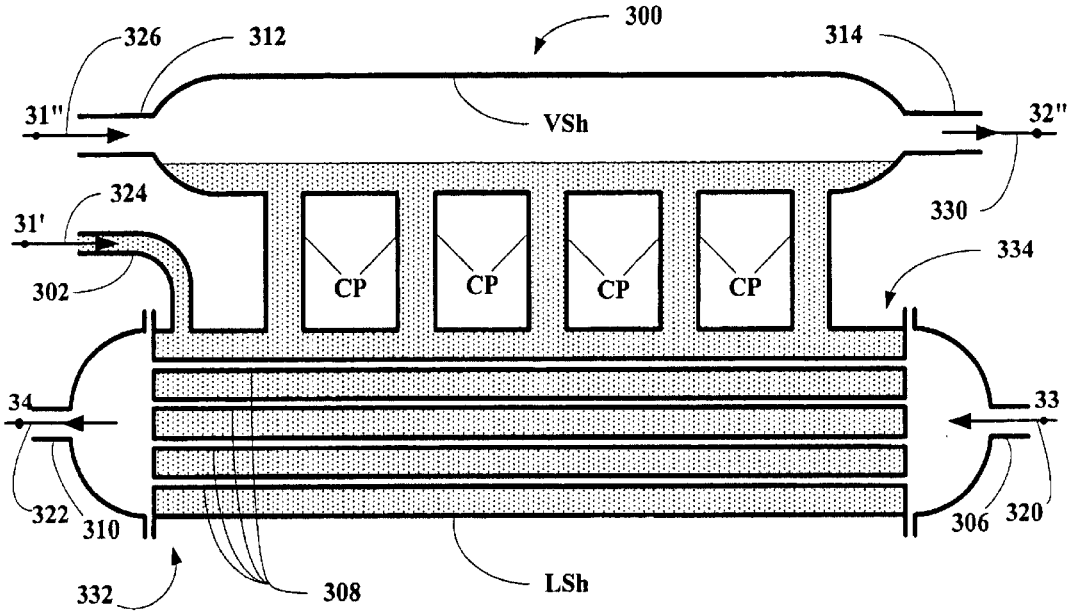
FIG. 3 depicts a diagram of another preferred embodiment of a heat transfer apparatus of this invention having a vapor removal apparatus.

Referring now to FIG. 3, a flow diagram of a preferred embodiment of a final boiling apparatus of this invention generally 300, is shown to include a liquid shell LSh, which is in essence a standard horizontally disposed shell-and-tube heat exchanger, a vapor shell VSh, which comprises a horizontal drum or hollow vessel installed above the liquid shell LSh, and a plurality of vertically disposed, connecting pipes CPs, which interconnect the liquid shell LSh and the vapor shell Vsh. The liquid shell LSh also includes only a liquid stream inlet 302. The liquid shell LSh further includes a heat source stream input 306, a plurality of heat transfer tubes 308 and a heat source stream output 310. The vapor shell VSH includes a vapor stream input 312 and a vapor stream output 314. In a case, the apparatus of this invention functions as a final vaporization apparatus, i.e., all liquid introduced into the apparatus is vaporized.

Like the apparatuses 100 and 200 of FIGS. 1 and 2, the apparatus 300 is designed to operate with an entire volume of the liquid shell LSh, an entire volume of the connecting tubes CPs and a lower portion of the vapor shell VSh being filled with liquid as shown by the dotted areas of the LSh and VSh. This configuration ensures that vaporization occurs in the liquid shell LSh in a substantially nucleate boiling process and that the produced vapor is sufficiently mixed with the liquid so that the liquid and vapor exiting the apparatus 300 are in equilibrium or are in substantial equilibrium.

The apparatus 300 of this invention operates by feeding a heat source stream 320, a hot liquid stream such as a geothermal brine stream, having initial parameters as at a point 33 into the liquid shell LSh via the heat source stream input 306. The heat source stream 320 passes through the heat transfer tubes 308 where it is cooled and leaves the liquid shell LSh as a spent heat source stream 322 having parameters as at a point 34 via the heat source stream output 310.

The apparatus 300 of FIG. 3 is designed to operate on a partially vaporize or mixed input stream (not shown) which is to be subjected to complete boiling and vaporization in the apparatus 300. In other words, the described process of FIG. 3 is a process of final vaporization, as distinct from initial or intermediate vaporization. The mixed stream enters the apparatus 300 as a liquid input stream 324 having parameters as at a point 31' via the liquid input 302 of the liquid shell LSh, while a vapor input stream 326 having parameters as at a point 31" enters the vapor shell VSh via the vapor input 312 of the vapor shell VSh. The liquid input stream 324 passes through the liquid shell LSh where it is heated by the heat source stream and completely boils. The vapor input stream 326 passes through the vapor shell VSh where it is fully mixed with the boiling liquid from the input liquid stream 324 rising up through the connecting tube CPs to form an output vapor stream 328 having parameters as at a point 2" via the vapor output 314 of the vapor shell VSh.

The stream to be further vaporized, which is comprised from a stream of vapor and a stream of liquid, enters into the apparatus as the liquid stream 324 and the vapor stream 326. The vapor stream 326 having the parameters as at the point 31" enters into the vapor shell VSh via the input 312 and the liquid stream 324 having the parameters as at the point 31' enters into the liquid shell Lsh via the input 302. As a result of heating, the liquid of the stream 324 which fills the liquid shell LSh, the connecting pipes CPs and the lower portion of the vapor shell VSh, varies its temperature and composition along a length of the apparatus 300; the stream 324 is cool and rich in light-component composition at a cold end 330 of the apparatus 300, and the stream 324 is hot and lean in light-component composition at a hot end 332 of the apparatus 300. As the liquid boils throughout the apparatus 300, bubbles of vapor move up and through the connecting pipes Cps and into the vapor shell VSh, carrying with them liquid (i.e., creating a thermo-syphoning effect). As a result of this thermo-syphoning, a significant quantity of liquid is delivered to the vapor shell VSh where it is thoroughly mixed with vapor in the vapor stream 326, bringing the vapor in the stream 326 into equilibrium with the liquid in the stream 324. It is self-evident that each connecting pipe CP delivers liquid having a different temperature and composition into the vapor shell VSh. With each addition of boiling liquid into the vapor in the vapor shell VSh, the vapor is the vapor shell VSh is brought step-wise into equilibrium with the liquid in the liquid shell LSh. Of course, as boiling liquid in the liquid shell LSh is moving up through the connecting pipes CPs and into the vapor shell VSh, liquid in the VSh is continually flowing down int the liquid shell LSh, an integral part of the mixing and equilibration process. As a result, the heat from the heat source fluid is transferred to the boiling liquid in a process of nucleate boiling, and then transferred to the vapor by way of mixing (i.e., direct contact heat and mass transfer).

Again, vapor produced in the apparatus 300 is then removed from the vapor shell VSh as the output vapor stream 330 having the parameters as at the point 32", and because the apparatus is a final vaporization unit, no remaining, non-vaporized liquid is produced. Due to the intensive mixing of liquid and vapor achieved in the vapor shell Vsh via the connecting pipes CPs, vapor the stream 330 having the parameters as at the points 2" is in equilibrium or very close to equilibrium with the liquid in the liquid shell LSh having a composition that is that same as the overall composition of the input stream, which is the purpose of the apparatus 300.

It is also clear that if the whole process of vaporization, from a state of saturated liquid to a state of saturated vapor, occurs in only one apparatus, then the entire stream introduced into the apparatus is comprised only of saturated liquid as shown in FIG. 2, and the entire stream removed from the apparatus is comprised only of saturated vapor as shown in FIG. 3.

Figure 4:
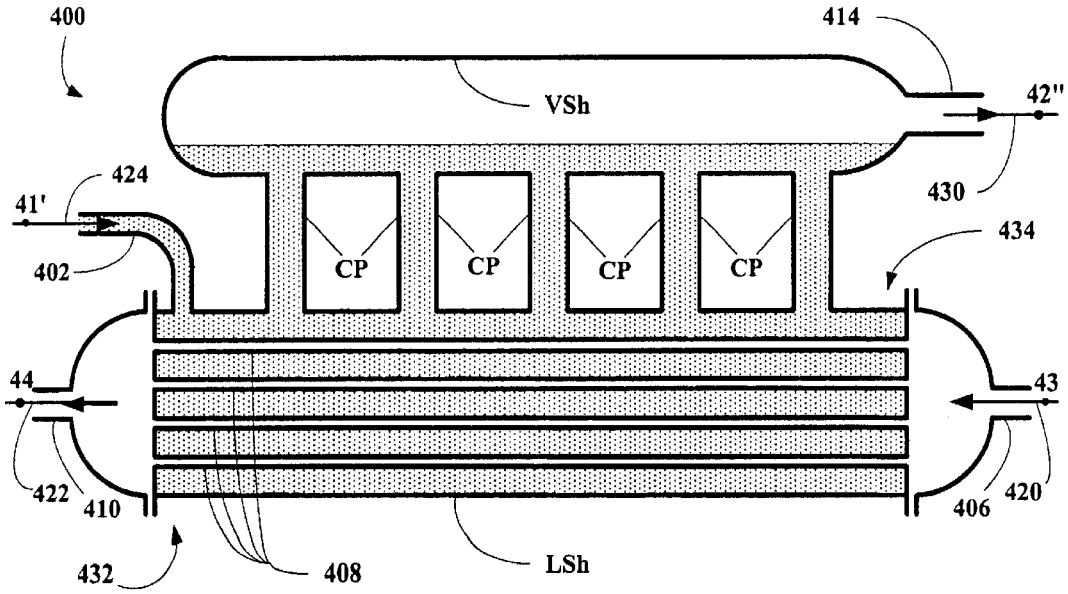
FIG. 4 depicts a diagram of another preferred embodiment of a heat transfer apparatus of this invention having a vapor removal apparatus.

Referring now to FIG. 4, a flow diagram of a preferred embodiment of a boiling apparatus of this invention, generally 400, is shown to include a liquid shell LSh, which is in essence a standard horizontally disposed shell-and-tube heat exchanger, a vapor shell VSh, which comprises a horizontal drum or hollow vessel installed above the liquid shell LSh, and a plurality of vertically disposed, connecting pipes CPs, which interconnect the liquid shell LSh and the vapor shell Vsh. The liquid shell LSh also includes a liquid stream inlet 402 and a liquid stream outlet 404. The liquid shell LSh further includes a heat source stream input 406, a plurality of heat transfer tubes 408 and a heat source stream output 410. The vapor shell VSH includes a vapor stream input 412 and a vapor stream output 414.

The apparatus 400 is designed to operate with an entire volume of the liquid shell LSh, an entire volume of the connecting tubes CPs and a lower portion of the vapor shell VSh being filled with liquid as shown by the dotted areas of the LSh and VSh. This configuration ensures that as vaporization occurs in the liquid shell LSH in a substainally nucleate boiling process, the produced vapor is sufficiently mixed with the liquid so that the liquid and vapor exiting the apparatus 400 are in equilibrium or are in substantial equilibrium.

The apparatus 400 of this invention operates by feeding a heat source stream 420, a hot liquid stream such as a geothermal brine stream, having initial parameters as at a point 3 into the liquid shell LSh via the heat source stream input 406. The heat source stream 420 passes through the heat transfer tubes 408 where it is cooled and leaves the liquid shell LSh as a spent heat source stream 422 having parameters as at a point 4 via the heat source stream output 410.

The apparatus 400 of FIG. 4 is designed to operate on a partially vaporize or mixed input stream (not shown) which is to be subjected to boiling and vaporization and further but not completely vaporized within the apparatus 400. In other words, the described process of FIG. 4 is a process of intermediate vaporization, as distinct from initial or final vaporization. The mixed stream enters the apparatus 400 as a liquid input stream 424 having parameters as at a point 1' via the liquid input 402 of the liquid shell LSh, while a vapor input stream 426 having parameters as at a point 1" via the vapor input 412 of the vapor shell VSh. The liquid input stream 424 passes through the liquid shell LSh where it is heated by the heat source stream and partially boils exiting the liquid shell LSh as a non-boiled liquid stream 428 having parameters as at a point 2' via the liquid output 404 of the liquid shell LSh. The vapor input stream 426 passes through the vapor shell VSh where it is fully mixed with the boiling liquid from the input liquid stream 424 rising up through the connecting tube CPs to form an output vapor stream 430 having parameters as at a point 2" via the vapor output 414 of the vapor shell VSh.

The stream to be further vaporized, which is comprised from a stream of vapor and a stream of liquid, enters into the apparatus as the liquid stream 424 and the vapor stream 426. The vapor stream 426 having the parameters as at the point 1" enters into the vapor shell VSh via the input 412 and the liquid stream 424 having the parameters as at the point 1' enters into the liquid shell Lsh via the input 402. As a result of heating, the liquid of the stream 424 which fills the liquid shell LSh, the connecting pipes CPs and the lower portion of the vapor shell VSh, varies its temperature and composition along a length of the apparatus 400; the stream 424 is cool and rich in light-component composition at a cold end 432 of the apparatus 400, and the stream 424 is hot and lean in light-component composition at a hot end 434 of the apparatus 400. As the liquid boils throughout the apparatus 400, bubbles of vapor move up and through the connecting pipes Cps and into the vapor shell VSh, carrying with them liquid (i.e., creating a thermo-syphoning effect). As a result of this thermo-syphoning, a significant quantity of liquid is delivered to the vapor shell VSh where it is thoroughly mixed with vapor in the vapor stream 426, bringing the vapor in the stream 426 into equilibrium with the liquid in the stream 424. It is self-evident that each connecting pipe CP delivers liquid having a different temperature and composition into the vapor shell VSh. With each addition of boiling liquid into the vapor in the vapor shell VSh, the vapor is the vapor shell VSh is brought step-wise into equilibrium with the liquid in the liquid shell LSh. Of course, as boiling liquid in the liquid shell LSh is moving up through the connecting pipes CPs and into the vapor shell VSh, liquid in the VSh is continually flowing down int the liquid shell LSh, an integral part of the mixing and equilibration process. As a result, the heat from the heat source fluid is transferred to the boiling liquid in a process of nucleate boiling, and then transferred to the vapor by way of mixing (i.e., direct contact heat and mass transfer).

Again, vapor produced in the apparatus 400 is then removed from the vapor shell VSh as the output vapor stream 430 having the parameters as at the point 2", while the remaining, non-vaporized liquid stream 428 is removed from the liquid shell LSh having the parameters as at the point 2'. Due to the intensive mixing of liquid and vapor achieved in the vapor shell Vsh via the connecting pipes CPs, vapor and liquid of the stream 430 and 428 having the parameters as at the points 2" and 2', respectively, are in equilibrium or very close to equilibrium, which is the purpose of the apparatus 400.

It must be noted that in all four cases set forth above, the liquid which is introduced into the apparatus is only a small portion of the total liquid available to the apparatus at any given time. Moreover, it is clear that, if needed, such an apparatuses can be installed consecutively (in series) and/or in parallel providing a process of effective vaporization of multi-component fluids having a wide range of boiling temperatures.

An apparatus based on the same principles, and designed for work at very high temperature (e.g., in a direct coal fired power systems) is shown in FIG. 4.

Figure 5:
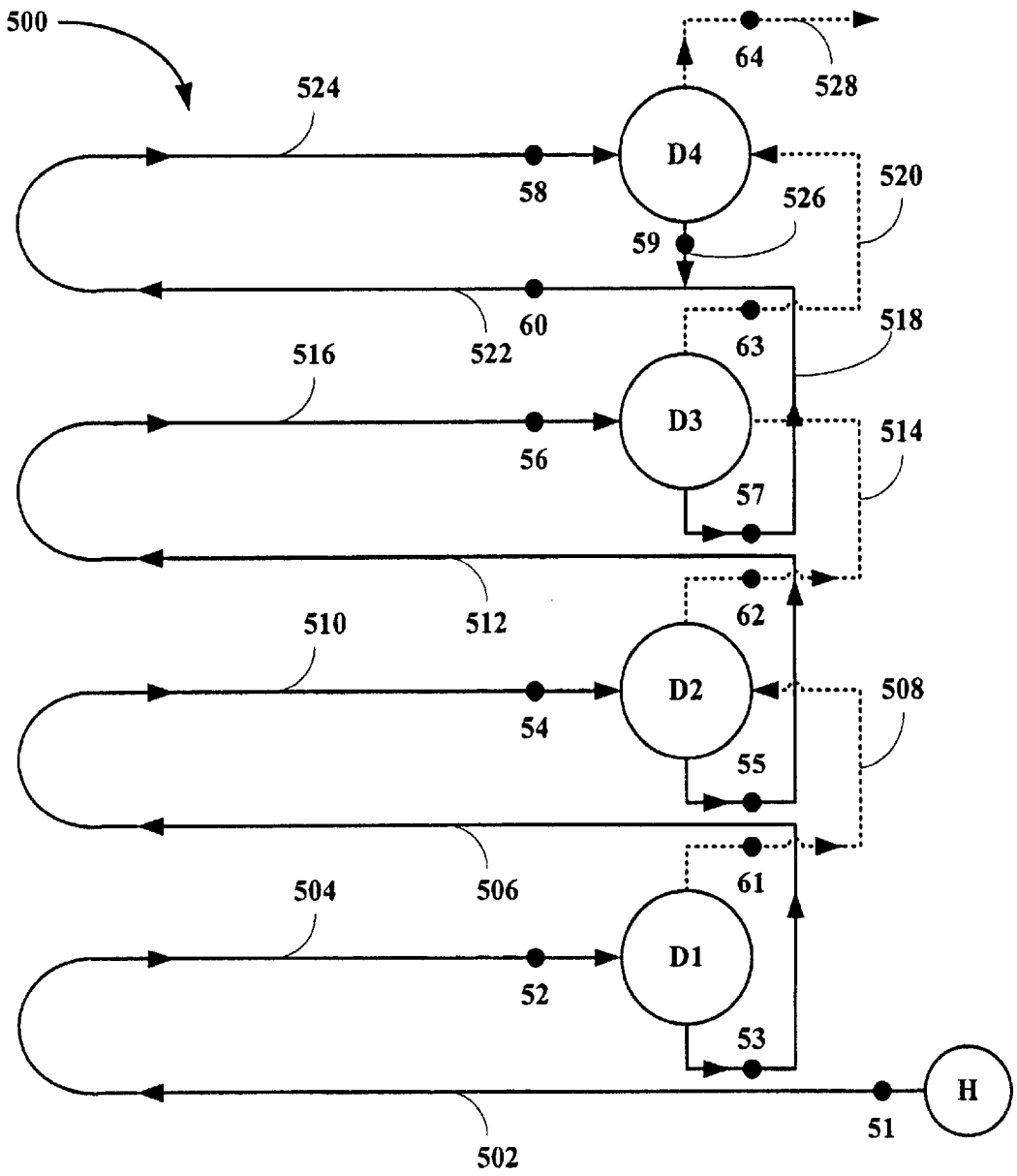
FIG. 5 depicts a diagram of a preferred embodiment of a heat transfer apparatus of this invention for use in high temperature furnace applications.

Referring now to FIG. 5, a preferred embodiment of a very high temperature vaporization system of this invention, generally 500, is shown to include four heat transfer loops HTL1–4. The four heat transfer loops HTL1–4 are designed to derive heat from an interior of a power plant furnace like a coal burning furnace. An input liquid stream 502, the stream to be vaporized, comprising saturated liquid and having parameters as at a point 51 is fed into the first heat transfer loop HTL1 from a header H.

The stream 502, after being partially vaporized in the loop HTL1, becomes a first mixed stream 504 having parameters as at a point 52 and enters into a drum Dl. In the drum D1, liquid is separated from vapor to form a first intermediate liquid stream 506 having parameters as at a point 53 and a first intermediate vapor stream 508 having parameters as at a point 61. The first intermediate liquid stream 508 having the parameters as at the point 53 passes through the second heat transfer loop HTL2.

The stream 508, after being partially vaporized in the loop HTL2, becomes a second mixed stream 510 having parameters as at a point 54 and enters a second drum D2 along with the first intermediate vapor stream 508 having the parameters as at the point 61. In the drum D2, liquid is separated from vapor to form a second intermediate liquid stream 512 having parameters as at a point 55 and a second intermediate vapor stream 514 having parameters as at a point 62. The second intermediate liquid stream 512 having the parameters as at the point 55 passes through the third heat transfer loop HTL3.

The stream 512, after being partially vaporized in the loop HTL3, becomes a third mixed stream 516 having parameters as at a point 56 and enters a third drum D3 along with the second intermediate vapor stream 514 having the parameters as at the point 62. In the drum D3, liquid is separated from vapor to form a third intermediate liquid stream 518 having parameters as at a point 57 and a second intermediate vapor stream 520 having parameters as at a point 63. The third intermediate liquid stream 518 having the parameters as at the point 57 is combined with a fourth intermediate liquid stream 526 having parameters as at a point 59 as described below to form a combined stream 522 which then passes through the fourth heat transfer loop HTL4.

The stream 522, after being partially vaporized in the loop HTL4, becomes a third mixed stream 524 having parameters as at a point 58 and enters a final drum D4 along with the third intermediate vapor stream 520 having the parameters as at the point 63. In the drum D4, liquid is separated from vapor to form the fourth intermediate liquid stream 526 having the parameters as at the point 59 and a final vapor stream 528 having parameters as at a point 64. The fourth intermediate liquid stream 526 having the parameters as at the point 59 is combined with the third intermediate liquid stream 518 to form the combined stream 522 as described above.

It should be recognized by an ordinary artisan that the heat exchange process in each heat transfer loop HTL1-4 are identical. Moreover, it should be recognized that four heat transfer loops is simply a convenient number for illustrating the process of this invention and the process can be operated by a minimum of 1 heat transfer loop and a maximum dependent on design criteria that can be as many as desired. Preferably, the number of heat transfer loops is between about 2 and about 20, particularly, between about 2 and about 16, and especially, between about 2 and 12.

As shown above, the proposed apparatus allows the maintenance of nucleate boiling in all heat transfer loops or heat exchangers where boiling occurs and at the same time, allows the production of vapor with the desired temperature and composition.

The apparatus provides for the full vaporization of multi-component fluids, the maintenance of high heat transfer coefficients in all boilers, and the protection of the boiler tubes from overheating in high temperature boilers.

In co-pending patent application bearing serial number (ref. "02019/05UTL), to achieve the same results, scrubbers were used in which the produced vapor would be brought into equilibrium with liquid by mixing in counter flow. The system proposed in the previous application also required that the process be performed in a minimum two heat exchangers. The use of scrubbers may require multiple introductions and removals of liquid and vapor into and from the scrubbers which requires a substantially complex control of the process.

This new apparatus does not require scrubbers. Effective equilibrium between vapor and liquid is achieved by multiple mixing of vapor and liquid, which occur essentially in the same apparatus as vaporization. Finally, the whole process of vaporization can be performed in just one apparatus if needed.

Figure 6:
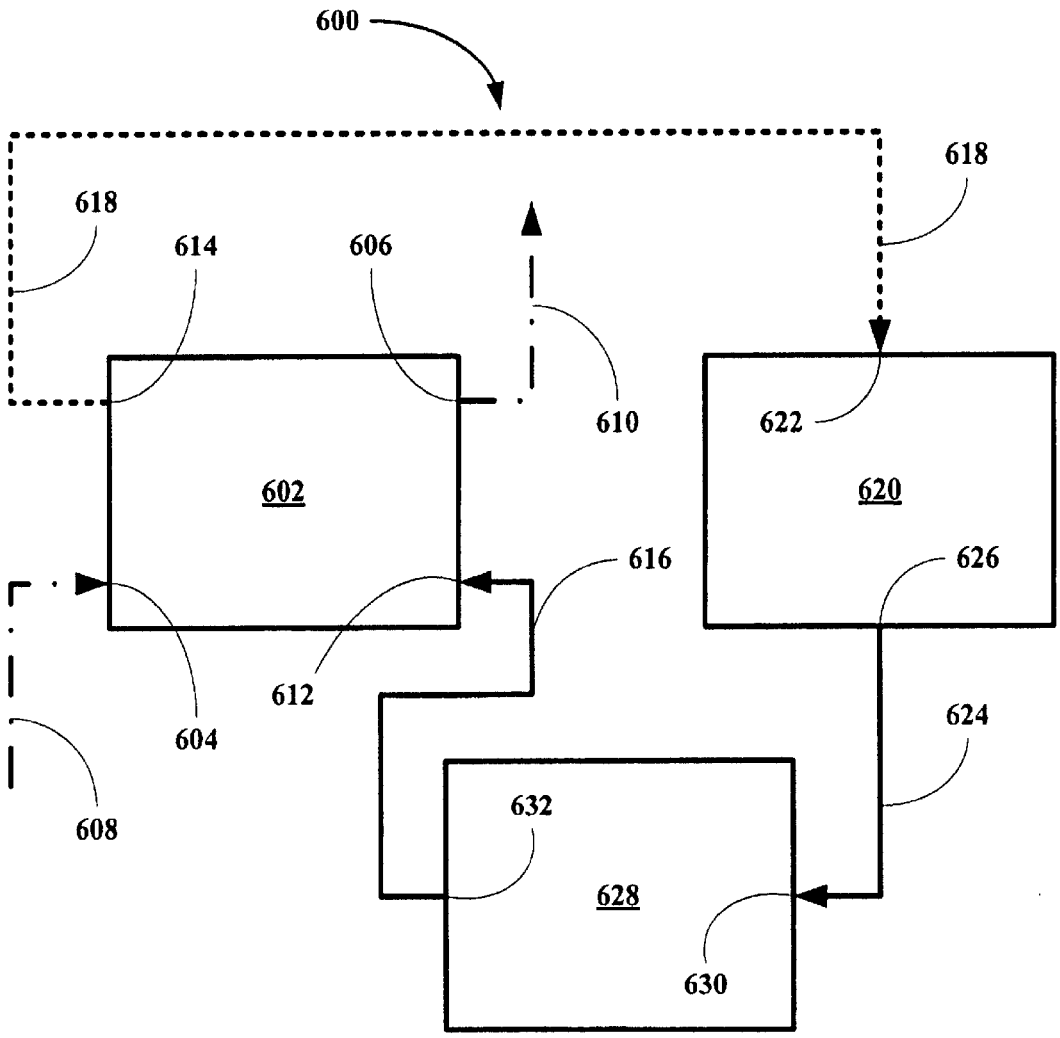
FIG. 6 depicts a diagram of heat extraction and useable energy production facility including a multi-component vaporization apparatus of this invention.

Referring now the FIG. 6, a preferred a heat extraction and energy production facility of this invention, generally 600, is shown to include a multi-component fluid vaporization apparatus of this invention 602. The apparatus 602 includes a heat source input 604 and a heat source output 606, where the input 604 inputs a heat source 608 shown here as an input heat source stream, but can be any other heat source and where the output 606 outputs a spent heat source 610 shown here as a spent heat source stream. Of course, if the heat source was focused sun light or other forms of electromagnetic radiation, then the input 604 would input light and the output 606 would output unused light.

The apparatus 602 also includes a liquid multi-component working fluid input 612 and a vapor multi-component working fluid output 614, where the liquid input 612 inputs an input liquid multi-component working fluid stream 616 and where the vapor output 614 outputs a final vapor multi-component working fluid stream 618. The final vapor stream 618 is input into an energy conversion unit 620 through a conversion unit vapor input 622. Energy is extracted from the final vapor stream 618 to produce a spent stream 624, which leaves the conversion unit 620 via a spent output 626. The spent stream 624 is forwarded to a condensation unit 628 via a condensation input 630 and leaves the condensation unit 628 as the input liquid stream 616 via a condensation output 632. Such energy conversion units can include any energy conversion unit known in the art including those described in U.S. Pat. Nos. 4,346,561; 4,489,563; 4,548,043; 4,586,340; 4,604,867; 4,674,285; 4,732,005;4,763,480; 4,899,545; 4,982,568; 5,029,444; 5,095,708; 5,440,882; 5,450,821; 5,572,871; 5,588,298; 5,603,218; 5,649,426; 5,754,613; 5,822,990; 5,950,433; 5,953,918; and 6,347,520; in co-pending U.S. patent application Ser. Nos. 10/242,301 filed 12 Sep. 2002; Ser. No. 10/252,744 filed 23 Sep. 2002; Ser. No. 10/320,345 filed 16 Dec. 2002, and Ser. No. 10/357,328 filed 3 Feb. 2003, Ser. No. 10/617,367, filed 10 Jul. 2003, and 10/, filed 23 Sep. 2003 bearing Express Mail Number EV 328 518 898 U.S., incorporated herein by reference.

Thus, the processes and apparatuses (systems) provide for the full vaporization of multi-component fluids, the maintenance of high heat transfer coefficients in the boilers, and the protection of the boiler tubes from overheating in high temperature boilers or other higher temperature heat transfer systems.

All references cited herein are incorporated herein by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

I claim:

1. A vaporization apparatus for multi-component working fluids comprising:

a heat transfer apparatus including:

a liquid shell having:

a liquid stream input;

a heat source stream input; and a heat source stream output, a vapor shell having a vapor stream output; and a plurality of pipes interconnecting the liquid shell and the vapor shell;

where the heat transfer apparatus is designed to receive an input liquid stream comprising a multi-component working fluid through its liquid input so that liquid fills an entire volume of the liquid shell, the connecting tubes and a lower portion of the vapor shell, which maintains nucleate boiling in the liquid shell and equilibrates the vapor and the liquid in the heat transfer apparatus.

2. The vaporization apparatus of claim 1, wherein the liquid shell further includes:

a non-vaporized liquid stream output.

3. The vaporization apparatus of claim 1, wherein the vapor shell further includes:

a vapor stream input.

4. A methods for vaporizing a multi-component working fluid comprising the steps:

feeding an input liquid multi-component working fluid stream having a given composition into an $n^{th}$ heat transfer apparatus comprising an $n^{th}$ heat exchange unit and an $n^{th}$ vapor removal unit;

transferring heat from a heat source in the $n^{th}$ heat exchange unit to the input liquid multi-component working fluid stream, where the heat causes a portion of the input liquid multi-component working fluid stream to boil;

removing vapor formed during the boiling via the $n^{th}$ vapor removal unit to form an $n^{th}$ vapor stream having a richer composition than the input liquid stream and an $n^{th}$ liquid stream having a higher temperature and a leaner composition than the input liquid stream;

forwarding the $n^{th}$ liquid stream to an $n-1^{th}$ heat transfer apparatus comprising an $n-1^{th}$ heat exchange unit and an $n-1^{th}$ vapor removal unit;

transferring heat from the heat source in the $n-1^{th}$ heat exchange unit to the $n^{th}$ liquid stream, where the heat causes a portion of the $n^{th}$ liquid stream to boil;

removing vapor formed during the boiling via the $n-1^{th}$ vapor removal unit to form an $n^{th}$ vapor stream having a richer composition than the $n^{th}$ liquid stream and an $n-1^{th}$ liquid stream having a higher temperature and a leaner composition than the $n^{th}$ liquid stream;

repeating the forwarding, transferring and removing step, while decrementing the counter by 1 until the counter has a numeric value of 1;

forwarding the $1^{st}$ liquid stream formed in the $1^{st}$ removing step and all of the vapor streams to a scrubber;

equilibrating the $1^{st}$ liquid stream and the vapor streams in the scrubber to produce a vapor multi-component working fluid stream having a composition substantially identical to the composition of input liquid multi-component working fluid stream and a remaining liquid stream; and combining the remaining liquid stream from the scrubber with one of the liquid stream prior to forwarding that liquid stream to the next heat transfer apparatus, where that liquid stream has a temperature and composition that most closely matches a temperature and composition of the remaining liquid stream, where vapor removal units associated with each heat transfer apparatus insure that substantially nucleate boiling occurs throughout each heat exchange unit.

5. A system for extracting heat from a heat source and converting a portion of the heat into a useable form of energy comprising:

a vaporization apparatus comprising:

a heat transfer apparatus including:

a liquid shell having:

a liquid stream input;
a heat source stream input; and
a heat source stream output,
a vapor shell having
a vapor stream output; and
a plurality of pipes interconnecting the liquid shell and the vapor shell;

a heat extraction apparatus, where heat from a heat source stream is transferred to a liquid multi-component working fluid stream having a given composition in the vaporization apparatus to produce a vapor multi-component working fluid stream having a substantially identical composition and where thermal energy transferred from the heat source stream to the vapor multi-component working fluid stream is converted into a more useable form of energy in the heat extraction apparatus.

6. The system of claim 5, wherein the liquid shell further includes:

a non-vaporized liquid stream output.

7. The system of claim 5, wherein the vapor shell further includes:

a vapor stream input.

8. A method for vaporizing a liquid multi-component working fluid comprising the steps of:

feeding a liquid multi-component working fluid stream from a energy production facility into a multi-component working fluid vaporization apparatus comprising:

a heat transfer apparatus including:
a liquid shell having:
a liquid stream input;
a heat source stream input; and
a heat source stream output,
a vapor shell having
a vapor stream output; and
a plurality of pipes interconnecting the liquid shell and the vapor shell;

inputting heat from a heat source into the multi-component working fluid vaporization apparatus, transferring the heat from the heat source to the liquid multi-component working fluid stream to produce a vapor multi-component working fluid stream; and sending the vapor multi-component working fluid stream back to the energy production facility, where the liquid multi-component working fluid and the vapor multi-component working fluid have substantially the same composition and the vaporization apparatus maintains substantially nucleate boiling throughout all heat exchanger units.

9. The method of claim 8, wherein the liquid shell further includes:

a non-vaporized liquid stream output.

10. The method of claim 8, wherein the vapor shell further includes:

a vapor stream input.

* * * * *